United States Patent [19]

Meier

[11] 4,321,760

[45] Mar. 30, 1982

[54] NOZZLE STRUCTURE FOR MOISTENING OR IMPREGNATING A WEB

[75] Inventor: Paul Meier, Winkel, Switzerland

[73] Assignee: Bachofen & Meier, Bulach, Switzerland

[21] Appl. No.: 128,762

[22] Filed: Mar. 10, 1980

Related U.S. Application Data

[63] Continuation of Ser. No. 912,614, Jun. 5, 1978, abandoned.

[30] Foreign Application Priority Data

Jun. 6, 1977 [CH] Switzerland ..... 6927/77

[51] Int. Cl.[3] ..... F26B 13/02

[52] U.S. Cl. ..... 34/155; 34/160; 239/135; 239/590.5

[58] Field of Search ..... 162/207, 290; 34/23, 34/155, 156, 160; 239/135, 590, 590.5

[56] References Cited

U.S. PATENT DOCUMENTS 3,238,635 3/1966 Gravenstreter ..... 34/23

3,587,177 6/1971 Overly ..... 34/156

*Primary Examiner*—Larry I. Schwartz

*Attorney, Agent, or Firm*—Pollock, Vande Sande & Priddy

[57] ABSTRACT

In a process for the moistening, impregnating and refining of a web of paper, carton, foil and the like, the web is treated in steam by the condensation effect of liquid supplied through nozzle bodies, and a precipitate is produced. An apparatus for carrying out the process has nozzle bodies arranged in a casing and connected to a steam supply, the nozzle bodies each containing a heater for heating the liquid and gas in a substantially pressureless condition in front of the nozzle outlets. Cooling elements are provided for the cooling of the web fed past the nozzle bodies, the whole being arranged such that, through the liquid being supplied, a condensation and thus a precipitation onto the surface of the web are produced.

12 Claims, 3 Drawing Figures

NOZZLE STRUCTURE FOR MOISTENING OR IMPREGNATING A WEB

This is a continuation, of application Ser. No. 912,614, filed June 5, 1978 now abandoned.

The present invention concerns a process for moistening, impregnating or refining a web of paper, carton, foil etc. and is more particularly concerned with an apparatus having an improved nozzle construction for carrying out this process.

Drying equipment for thin webs, using nozzles which keep the dry web in a suspended state is known, per se. In the USA and in Switzerland, such drying nozzles are commercially available under the name of "Airfoil". These work according to Bernoulli's theorem of the wings of an aeroplane. It is known that the static pressure above such as Airfoil nozzle is lower than above the web, and the latter is thus kept motionless through the air flow. A stable state of equilibrium is achieved which guarantees a perfect contact-free web guidance even where varying widths are concerned.

The process of the present invention for the moistening, impregnating or refining of a web of paper, carton, foil etc. is characterised by the web being treated by steam through the condensation effect of liquid being supplied via nozzle bodies, and by a precipitate being produced.

The apparatus of the present invention for carrying out this process comprises nozzle bodies arranged in a casing and connected to a steam supply, each containing in front of the nozzle outlets a heater for overheating the liquid or the gas in a practically pressureless condition; and the apparatus also includes cooling elements for cooling the web being treated as said is led past the nozzle bodies whereby a condensation and thus a precipitate is produced on the surface of the web. dr

BRIEF DESCRIPTION OF THE DRAWINGS

The drawing represents an exemplified embodiment of the plant required for carrying out this process, of which

DESCRIPTION OF THE PREFERRED EMBODIMENT

Figure 1:
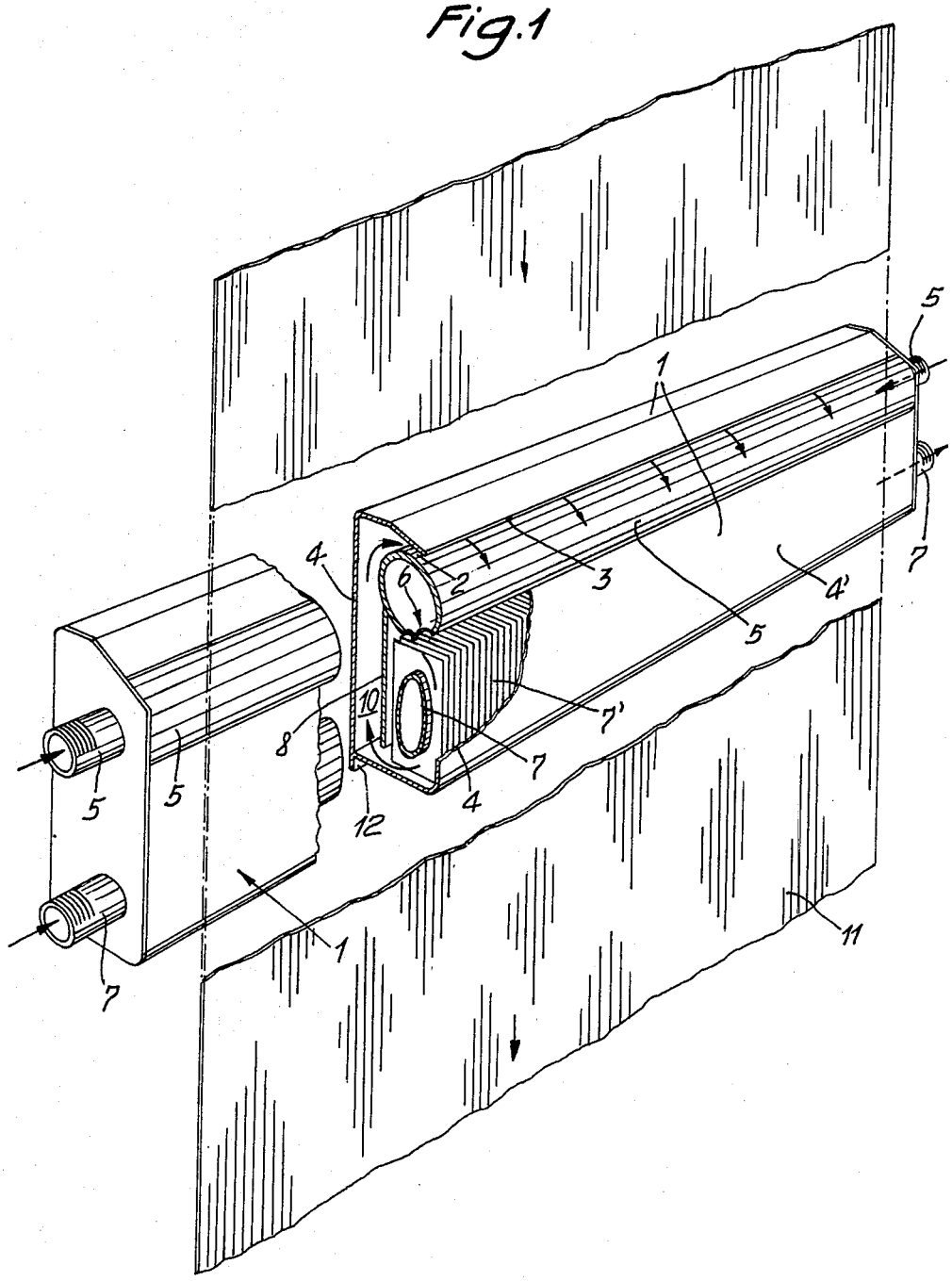
FIG. 1 represents a diagrammatic representation of a nozzle body constructed in accordance with the present invention, and shown in partial section.
Figure 2:
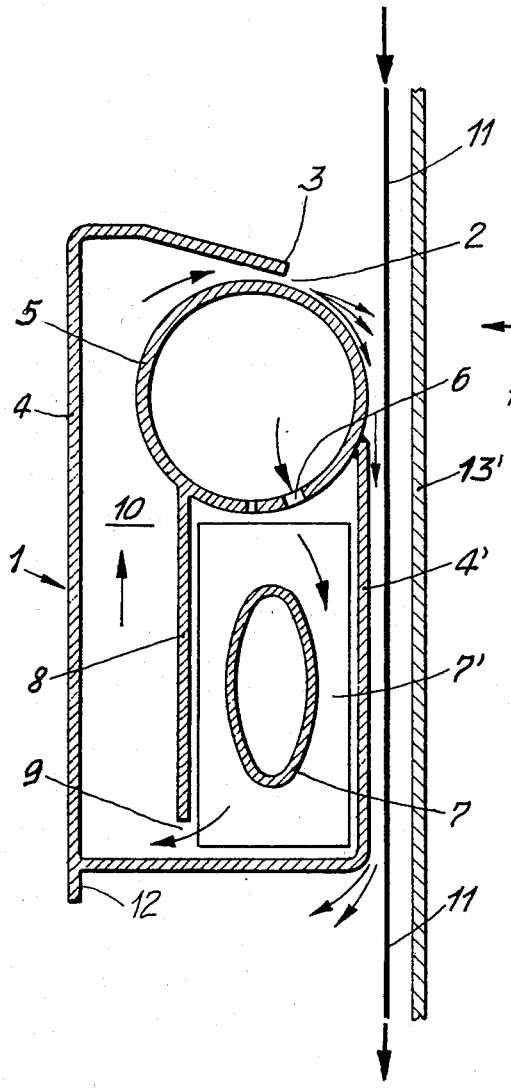
FIG. 2 represents a vertical section of the nozzle body of FIG. 1 on a larger scale, and FIG. 3 contains a schematic representation of an apparatus employing the improved nozzles of the present invention, which apparatus includes several nozzle bodies, with the web being fed through the apparatus past said nozzle.

Referring initially to FIGS. 1 and 2 of the drawing, a nozzle 1 is formed by an oblong housing 4 which is provided with a slot-like nozzle outlet 2 for the delivery of hot water vapor to a moving web 11 of paper or the like. The outlet 2 is formed by the upper edge 3 of the wall of the housing 4 and a pipe 5 arranged in the upper part, said pipe 5 extending in a direction parallel to and closely adjacent to one face of moving web 11 (see FIG. 2) and being used for the delivery of steam to the nozzle for the moistening or refining of web 11. The pipe 5 is fixed to the upper edge of the front wall 4' of the housing 4 by a welded joint (FIG. 2), and is provided with discharge ports 6 on its bottom surface through which the steam in pipe 5 can escape downwards. The elements 7, 7' constitutes an oblong heater developed as a radiator and arranged along the bottom of the pipe 5, over which the steam coming out of the discharge ports passes. A liquid or gaseous heating medium passes through the pipe 7 of the radiator. An electric heater may also be fitted in pipe 7. A separating wall fixed to pipe 5 and dividing the hollow space of the nozzle body into two longitudinal halves; this separating wall does not extend right down to the housing base but forms a gap 9 for the entry of the hot gasses into the circulation space 10. There, the hot gasses rise and escape through the nozzle outlet 2. 11 represents the web to be treated passing the nozzle body 1. 12 represents a drip edge for the condensate formed during the operation of the apparatus, this drip edge projecting downwards and being formed by an extension of the rear wall of the housing 4.

The heater 7, 7' serves to overheat the liquid or the gas in front of the nozzle outlet 2. This effect is of large, even decisive significance for the process and the apparatus used for this purpose. E.g. if one operates with wet steam which has a relatively low heat content, and if this steam is overheated, the heat content only increases insignificantly. Consequently, the substratum being treated is not heated quickly. As experience has shown overheated steam with a small heat content also cannot give off much heat.

Figure 3:
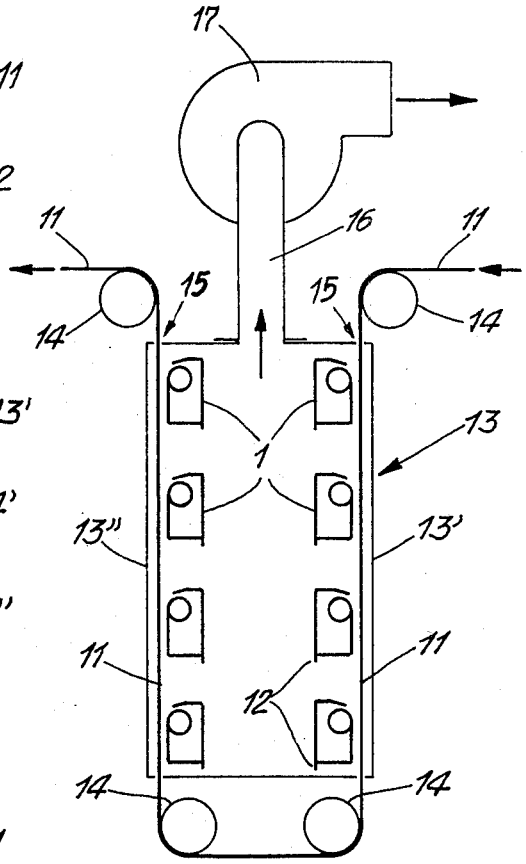

As shown in FIG. 3, the web 11 to be treated is passed within a casing 13 between the walls of the wide sides 13' and 13" respectively on one hand, and groups of nozzle bodies 1 each of which is constructed in the manner described above and each of which is arranged at a distance from these casing slides on the other hand. Guide and deflector rolls 14 are arranged above and below the casing 13, these rolls being at the same time developed as cooling rollers. With the exception of slots 15 for the passing through of the web, the casing 13 is sealed on all sides. A discharge pipe 16 with an associated suction element 17 emanates from the top of the casing 13.

As shown in FIG. 2, the slot-like nozzle outlet 2 developed between the edge 3 of the housing wall 4 of each nozzle body 1 and the associated pipe 5 is directed in a downwardly inclined manner adjacent the web moving downwards, subjecting the latter—as it is the case with the Airfoil nozzle—to a suspension effect. The steam flowing between the web 11 and the casing walls 13' and 13" respectively as well as between the groups of nozzle bodies, produces in the area of the nozzle outlet 2—similar to the Airfoil principle—a bigger static pressure than in the remaining area of the web. Since the static pressure is smaller next to the nozzle outlet 2 than it is on the side of the web which is turned away, the web is kept suspended by the air flow. This results in a stable state of equilibrium which safeguards a perfect and contact-free web guidance, even where varying widths are concerned.

The apparatus can be built both for one-sided as well as double-sided application onto the web 11. It also permits applications where the rear of the web must not be thermally loaded.

The moistening is also necessary if the web 11 e.g. was treated on one side and there are difficulties with the plane surface. Moistening should also take place if for technical reasons a hard-drying of the web becomes necessary and a normal degree of moisture has subsequently got to be reached again. Water in the wet to saturated steam is particularly suited for moistening purposes of the web. Of course, any other liquid convertible into a vapor may be used. The liquid could, furthermore, be a solution which refines or impregnates the web in order to make it e.g. water-tight, water-repellent, flame-resistant, moth-proof or rot-proof. It does not matter of what material the web to be treated does consist; paper, carton, foils etc. are particularly suited for treatment by the present invention.

I claim:

1. A nozzle operative to apply a gaseous medium to a web of paper or the like to moisten or treat said web as said web is fed past said nozzle, said nozzle comprising an elongated housing adapted to extend in a direction transverse to the direction of feeding of the web across one face of the web, said housing including an elongated pipe extending therethrough at a position closely adjacent the web and parallel to said one face of said web, said pipe being adapted to be supplied with a gaseous medium, said housing further including a front wall extending downwardly from said pipe in a plane closely adjacent to but spaced from said one face of said web, a bottom wall spaced from said pipe and extending rearwardly from said front wall away from said one face of said web, a rear wall extending upwardly from said bottom wall to a position above said pipe, and a top wall extending from said rear wall toward said one face of said web, said top wall including an edge which is positioned adjacent to but spaced from an upper surface of said steam pipe to define an elongated nozzle outlet between said pipe and said top wall edge, an interior wall in said housing extending downwardly from said pipe in spaced relation to said front wall and rear wall, the lower edge of said interior wall being spaced from said bottom wall of said housing, heater means in the region defined between the bottom of said pipe, said front and interior walls, and said bottom wall, and a plurality of ports in said pipe opening into said region, whereby a gaseous medium passing through said pipe flows through said ports into said region and past said heater means between said front and interior walls, then passes through the space between the lower edge of said interior wall and said bottom wall, flows through the region defined between said interior wall, said rear wall, and a rear surface of said pipe, and emerges from said nozzle outlet toward said moving web to flow past said web in the space defined between a forward surface of said pipe and said front wall.

2. The nozzle of claim 1 wherein said heater means comprises a further elongated pipe extending in a direction parallel to said first mentioned pipe and having a heated medium flowing therethrough.

3. The nozzle of claim 1 wherein the gaseous medium in said pipe is steam, said heater means being operative to overheat the steam which emerges from said ports into said region.

4. The nozzle of claim 3 wherein said housing includes a condensate drip edge extending downwardly from said bottom wall adjacent the junction of said bottom and rear walls.

5. The nozzle of claim 1 wherein said front wall, said rear wall, and said interior wall are all substantially parallel to one another.

6. The nozzle of claim 1 wherein said nozzle outlet is inclined downwardly relative to the direction of feed of the web.

7. A nozzle for applying a heated gaseous medium to a moving web of paper or the like as said web moves past said nozzle, said nozzle comprising an elongated housing adapted to have one of its exterior faces disposed adjacent to but spaced from the web with the direction of elongation of said housing oriented transverse to the direction of movement of the web, wall means in said housing subdividing the interior of said housing into first and second elongated channels that extend in side-by-side relation to one another within said housing in the direction of elongation of said housing, inlet means in said housing for supplying a heated gaseous medium to one end of said first elongated channel, said wall means defining a plurality of ports within said housing that are spaced from one another in the direction of elongation of said first and second elongated channels for passing the heated gaseous medium supplied to said first elongated channel from said first channel into said second elongated channel in flow directions that are transverse to the directions of elongation of said first and second elongated channels, an elongated heater within said second elongated channel extending in the direction of elongation of said second channel, said heater including a plurality of radiator plates that are disposed in spaced closely adjacent relation to one another in planes transverse to the direction of elongation of said second channel for raising the temperature of the heated gaseous medium which flows through said ports into said second channel and past said spaced radiator plates, and an elongated slot-like outlet in said housing extending in the direction of elongation of said housing in the exterior face of said housing which is adapted to face the moving web, said elongated slot-like outlet being in communication with said elongated second channel at a position downstream of said elongated heater for supplying the raised-temperature gaseous medium from said second elongated channel to the moving web, the exterior face of the housing which is adapted to face the moving web including inclined walls adjacent to and defining said elongated slot-like opening, said inclined walls being oriented to direct the raised-temperature gaseous medium emerging from said slot-like opening toward the space which is defined between said housing and the web when said exterior face of said elongated housing is disposed adjacent to but spaced from the moving web thereby to cause said gaseous medium to flow through said space in directions generally parallel to the plane of the moving web.

8. The nozzle of claim 7 wherein said heater comprises an elongated pipe disposed within said second channel in the direction of elongation of said second channel, said radiator plates being attached to the exterior of said elongated pipe in spaced relation to one another along said pipe, and means for heating the interior of said pipe to heat said radiator plates.

9. The nozzle of claim 8 wherein said means for heating the interior of said pipe comprises further inlet means in said housing for supplying a heated medium to one end of said pipe.

10. The nozzle of claim 7 wherein said first and second elongated channels, said elongated heater, and said elongated slot-like outlet each extends for substantially the full length of said elongated housing.

11. The nozzle of claim 7 wherein said inlet means is operative to supply steam to said one end of said first elongated channel, said heater being operative to overheat said steam whereby overheated steam emerges from said elongated slot-like outlet.

12. The nozzle of claim 11 wherein said elongated housing includes condensate removal means located at a position remote from the exterior face of the housing which is adapted to face the moving web.

* * * * *